US008984899B2

(12) United States Patent
Mitchell

(10) Patent No.: US 8,984,899 B2
(45) Date of Patent: Mar. 24, 2015

(54) REFRIGERATOR APPLIANCE WITH ICE DISPENSER

(75) Inventor: Alan Joseph Mitchell, Louisville, KY (US)

(73) Assignee: General Electric Company, Schenectady, NY (US)

( * ) Notice: Subject to any disclaimer, the term of this patent is extended or adjusted under 35 U.S.C. 154(b) by 311 days.

(21) Appl. No.: 13/279,640

(22) Filed: Oct. 24, 2011

(65) Prior Publication Data

US 2013/0098099 A1 Apr. 25, 2013

(51) Int. Cl.

| | |
|---|---|
| ***F25C 1/00*** | (2006.01) |
| ***F25C 5/18*** | (2006.01) |
| ***F25D 25/02*** | (2006.01) |
| ***B67D 7/00*** | (2010.01) |
| ***F25C 5/00*** | (2006.01) |

(52) U.S. Cl.
CPC .... *B67D 7/00* (2013.01); *F25C 5/00* (2013.01)
USPC ..... 62/66; 62/381; 62/344

(58) Field of Classification Search
CPC ..... F25C 5/002; F25C 5/005; F25C 5/007; F25C 5/16; F25C 2500/08; B65D 83/0011; B65B 1/12; B65G 1/07; B65G 65/365; A01F 25/20
USPC ..... 62/66, 320, 344, 381; 222/146.6, 390, 222/544, 322, 405, 342; 366/155.1, 155.2
See application file for complete search history.

(56) References Cited

U.S. PATENT DOCUMENTS

| | | | | | |
|---|---|---|---|---|---|
| 650,569 | A | * | 5/1900 | Shaw | 222/227 |
| 2,735,591 | A | * | 2/1956 | Branchflower | 222/405 |
| 3,063,585 | A | * | 11/1962 | Bruecker | 414/808 |
| 4,228,934 | A | * | 10/1980 | Carr | 222/412 |
| 4,930,685 | A | | 6/1990 | Landers | |
| 6,082,130 | A | * | 7/2000 | Pastryk et al. | 62/344 |
| 2004/0255600 | A1 | * | 12/2004 | Lebowitz | 62/66 |
| 2004/0261442 | A1 | * | 12/2004 | Chung et al. | 62/344 |
| 2006/0277937 | A1 | * | 12/2006 | Schlosser et al. | 62/344 |
| 2008/0156826 | A1 | * | 7/2008 | Kim et al. | 221/258 |
| 2009/0165492 | A1 | * | 7/2009 | Wilson et al. | 62/344 |
| 2010/0175412 | A1 | * | 7/2010 | Kim | 62/320 |

* cited by examiner

*Primary Examiner* — Mohammad M Ali
*Assistant Examiner* — Christopher R Zerphey
(74) *Attorney, Agent, or Firm* — Dority & Manning, P.A.

(57) ABSTRACT

The present disclosure relates to an ice bucket for a refrigerator and methods of using the same. The ice bucket is mounted on a door of the refrigerator and includes a platform that is movable along a vertical axis from a lowered position at a bottom portion of the ice bucket to a raised position at a top portion of the ice bucket.

18 Claims, 6 Drawing Sheets

REFRIGERATOR APPLIANCE WITH ICE DISPENSER

FIELD OF THE INVENTION

The subject matter disclosed herein relates generally to a refrigerator appliance with an ice dispenser.

BACKGROUND OF THE INVENTION

Various ice dispenser designs have been proposed for refrigeration appliances such as commercial or home refrigerators and/or freezers. Some of these devices store ice prior to dispensing the ice to a user.

Generally, current ice dispensers store ice in a bucket or container prior to dispensing the ice. In such current designs, storage of ice in the bucket or container is needed due to the limited production capabilities of the ice dispenser's ice maker. For example, the ice maker generally produces small batches of ice and takes a significant amount of time to produce any particular batch of ice.

Despite such limited ice production capabilities, the storage of ice in the bucket or container allows the ice dispenser to collect and dispense a large amount of ice at any particular time or over a period of time. Thus, the storage of ice can allow the ice dispenser to meet user demands for more ice than the dispenser's ice maker can produce at any particular time. The storage of ice can also allow the dispenser to meet user demands for more ice over a given period of time than can be produced by the ice dispenser's ice maker during the same time period.

Certain conventional ice dispensers store ice in a bucket or container that is mounted inside a compartment of the refrigerator e.g., in a freezer compartment of the refrigerator. However, the bucket or container mounted inside the compartment may decrease the amount of storage space available in the compartment. In addition, the bucket or container mounted inside the compartment may be difficult to access by a user. For example, a user attempting to e.g., manually collect ice from the container or to determine the amount of ice in the container may be prevented from doing so by items stored in the compartment. The location of the container in the freezer compartment may make access difficult.

In addition, certain conventional ice dispensers store ice in a bucket or container having a hole or other opening that allows ice to flow out of the bucket or container to a user. Thus, in certain conventional ice dispensers, gravity may urge ice stored in the bucket or container to flow through a hole on a bottom wall of the bucket or container. However, ice stored for a long period of time may freeze together and impede the flow of ice through a hole, and, in addition, certain ice cube shapes are not conducive to flow through a hole.

Accordingly, new ice dispenser designs are needed that can increase the amount of storage space available in refrigerators, allow users to more readily access stored ice, and assist the flow of ice through the dispenser.

BRIEF DESCRIPTION OF THE INVENTION

Aspects and advantages of the invention will be set forth in part in the following description, or may be obvious from the description, or may be learned through practice of the invention.

In a first embodiment, the present subject matter discloses a refrigerator that includes a door configured to permit selective access to a compartment of the refrigerator, an ice maker, and an ice storage assembly disposed on the door. The ice dispenser assembly has an ice bucket configured to receive ice from the ice maker. The ice dispenser assembly also includes an ice chute adjacent the ice bucket and having an upper portion configured to receive ice from the ice bucket. The ice dispenser assembly also includes a platform movable along a vertical axis from a lowered position at a bottom portion of the ice bucket to a raised position at a top portion of the ice bucket and a lift mechanism operatively coupled to the platform such that the lift mechanism selectively adjusts the elevator platform from the lowered position to the raised position.

In a second embodiment, the present subject matter discloses a method for dispensing ice. The method includes creating ice in an ice maker of a refrigerator receiving the ice from in an ice bucket on a door of the refrigerator, raising a platform of the ice bucket along a vertical axis from a lowered position at a bottom portion of the ice bucket to a raised position at a top portion of the ice bucket, and transferring the ice from the top portion of the ice bucket to an ice chute of the ice bucket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
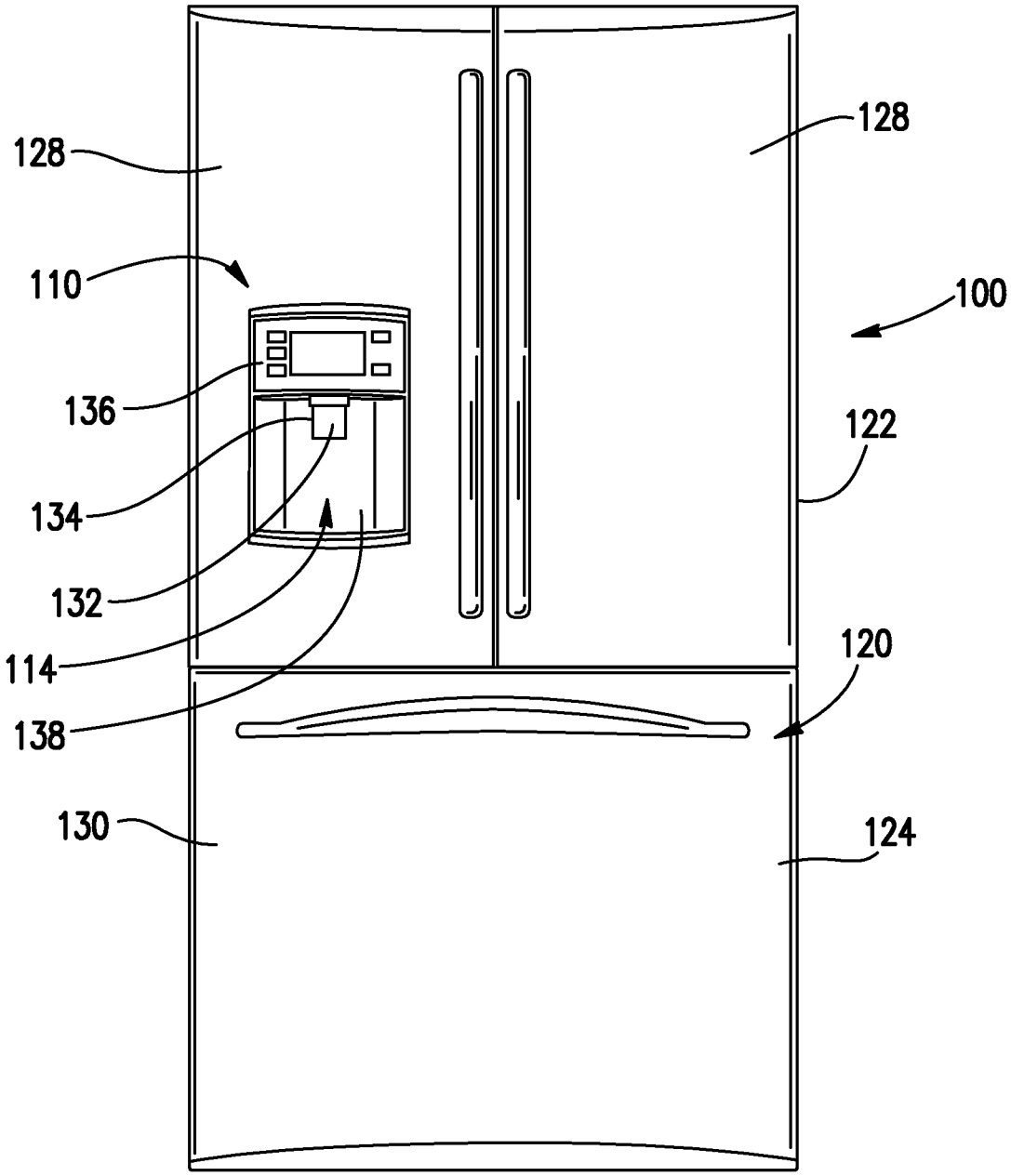
FIG. 1 illustrates a front view of an exemplary embodiment of a refrigerator that includes an exemplary ice dispensing assembly in accordance with certain aspects of the present disclosure. The refrigerator of FIG. 1 is generally referred to as a bottom mount style refrigerator.

The present disclosure relates to an ice bucket for a refrigerator and methods of using the same. The ice bucket is mounted on a door of the refrigerator and includes a platform that is movable along a vertical axis from a lowered position at a bottom portion of the ice bucket to a raised position at a top portion of the ice bucket. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a front view of a refrigerator 100 including an ice dispensing assembly 110 for dispensing water and/or ice. The ice dispensing assembly 110 includes a dispenser 114 positioned on an exterior portion of refrigerator 100. The refrigerator 100 includes a housing 120 defining an upper fresh food compartment 122 and a lower freezer compartment 124 arranged at the bottom of refrigerator 100. As such, the refrigerator 100 is generally referred to as a bottom mount refrigerator. It is recognized, however, that the benefits of the present disclosure apply to other types and styles of refrigerators such as, for example, a top mount refrigerator or a side-by-side style refrigerator, e.g., the refrigerator shown in FIG. 5. Consequently, the description set forth herein is for illustrative purposes only and is not intended to be limiting in any aspect.

As may be seen in FIG. 1, refrigerator doors 128 are rotatably hinged to an edge of the housing 120 for selectively accessing the fresh food compartment 122. In addition, a freezer door 130 is arranged below the refrigerator doors 128 for selectively accessing the freezer compartment 124. The freezer door 130 is coupled to a freezer drawer (not shown) slidably coupled within freezer compartment 124. In FIG. 1, the refrigerator doors 128 and freezer door 130 are shown in a closed configuration.

The dispenser 114 includes a discharging outlet 132 for accessing ice and water. A single paddle 134 is mounted below the discharging outlet 132 for operating the dispenser 114. In addition, a control panel 136 is provided for controlling the mode of operation. For example, the control panel 136 may include a water dispensing button (not labeled) and an ice-dispensing button (not labeled) for selecting a desired mode of operation.

The discharging outlet 132 and paddle 134 are an external part of dispenser 114, and are mounted in a concave portion 138 defined in an outside surface of the refrigerator door 128. The concave portion 138 is positioned at a predetermined elevation convenient for a user to access ice or water thus enabling the user to access ice without the need to bend-over and without the need to access the freezer compartment 124. In the exemplary embodiment of FIG. 1, the concave portion 138 is positioned at a level that approximates the chest level of a user.

Figure 2:
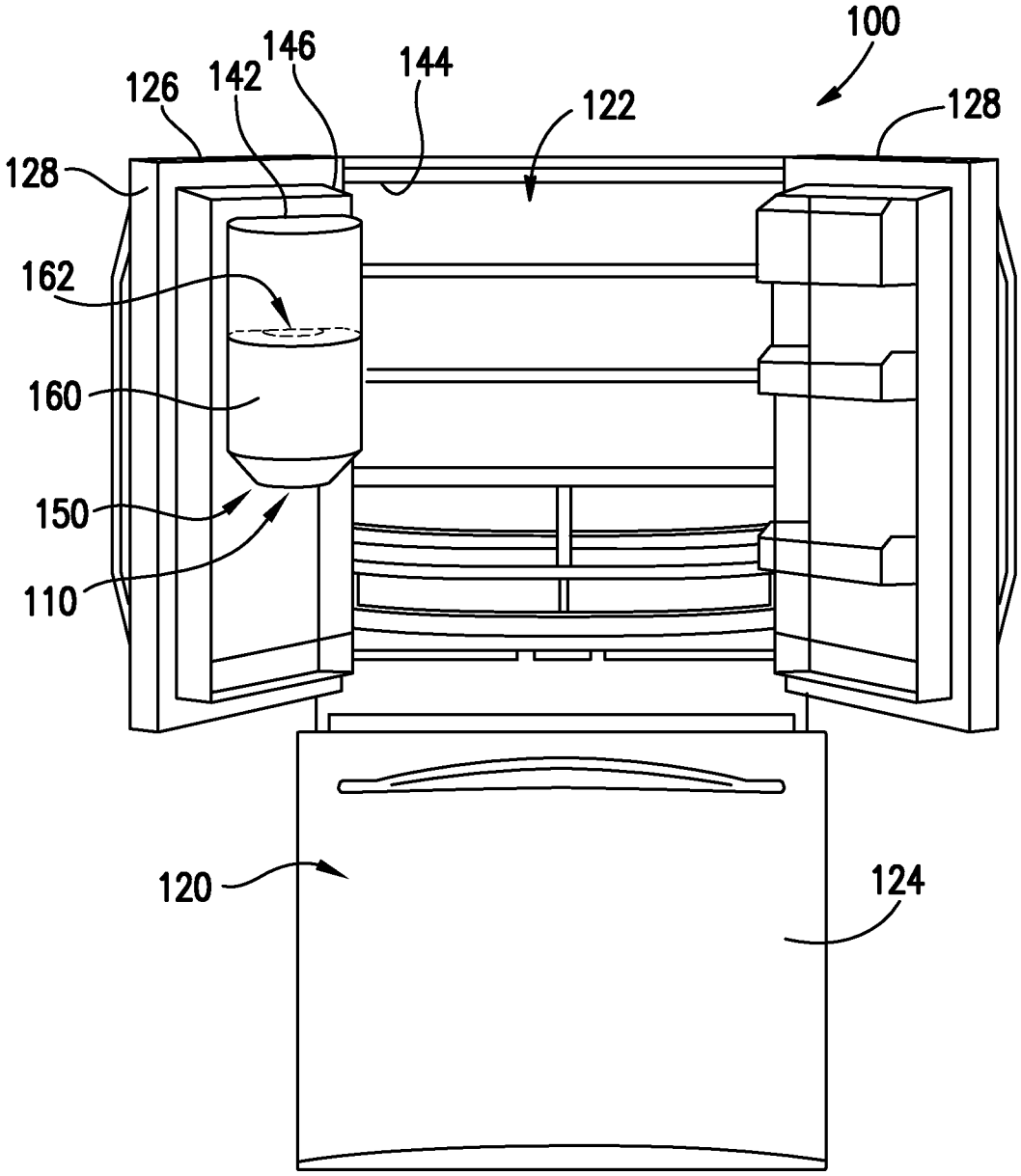
FIG. 2 illustrates a perspective view of the exemplary refrigerator shown in FIG. 1, having a refrigerator door in an open position.

FIG. 2 is a perspective view of the refrigerator 100 of FIG. 1 having the refrigerator doors 128 in an open configuration. As such, various components of ice dispensing assembly 110 are illustrated. The ice dispensing assembly 110 includes an insulated housing 142 disposed on a particular one of the refrigerator doors 128. However, it should be understood that in alternative embodiments, the insulated housing 142 may be disposed at any suitable location within the refrigerator 100. Thus, for example, the insulated housing 142 may be mounted within the fresh food compartment 122 along an upper surface 144 of the compartment 122 or along a sidewall 146 of the compartment 122. The insulated housing 142 may have insulated walls defining an insulated cavity (not shown). Due to the insulation which encloses the cavity, the temperature within the cavity may be maintained at levels different from the temperature in the surrounding fresh food compartment 122. Thus, in the exemplary embodiment of FIG. 2, the insulated cavity is constructed and arranged to operate at a temperature that facilitates producing and storing ice. Accordingly, the insulated housing includes an ice maker (not shown) disposed within the insulated housing 142 and configured to selectively produce ice.

Using the teaching disclosed herein, one of skill in the art will understand that in alternative embodiments of the invention, the ice maker portion of the ice dispensing assembly 110 need not be disposed within the insulated housing 142. Thus, for example, ice maker portion of the dispensing assembly 110 may be disposed within the freezer compartment 124 of a refrigerator appliance having a side-by-side configuration of the fresh food compartment 122 and the freezer compartment 124. In such example, because the temperature of the freezer compartment 124 allows for the production of ice, the ice maker portion of the ice dispensing assembly 110 need not be disposed within the insulated cavity 142 to produce ice.

As may be seen in FIG. 2, the ice dispensing assembly 110 also includes an ice storage assembly 150 coupled to a particular one of the refrigerator doors 128. The ice storage assembly 150 is configured to receive and store ice produced by the ice maker in the insulated housing 142. Thus, as shown in FIG. 2, the ice storage assembly 150 includes an ice bucket 160 that is positioned proximate to and vertically below a portion of the insulated housing 142 in order to receive ice produced by the ice maker. However as discussed above, in alternative embodiments, the insulted housing 142 may be disposed in the fresh food compartment 122 rather than on the refrigerator door 128. In such embodiments, in order to receive ice from the ice maker within the insulated housing 142 in the fresh food compartment 122, the ice bucket 160 on the refrigerator door 128 is positioned proximate to and vertically below a portion of the insulated housing 142 when the refrigerator door 128 is in a closed configuration.

The ice dispensing assembly 110 also includes a water tank (not shown) for storing a predetermined amount of water therein. The water tank is also in communication with the discharging outlet 132 (shown in FIG. 1) such that water can be dispensed through the refrigerator doors 128.

Figure 3:
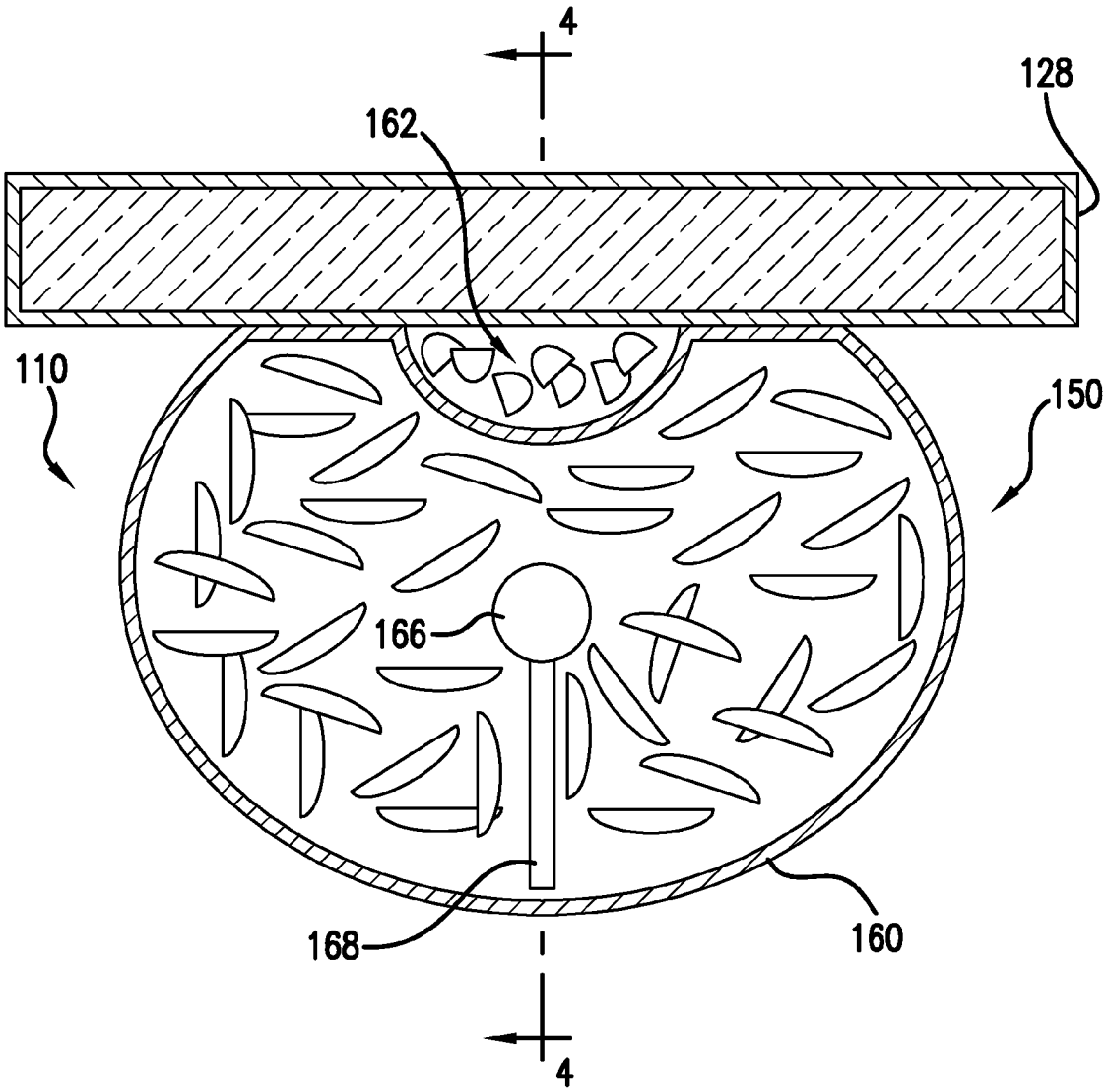
FIG. 3 illustrates a top view of the exemplary embodiment of an ice dispenser assembly taken along line 3-3 of FIG. 4.

FIG. 3 illustrates a top view of the exemplary ice dispenser assembly 150 of FIG. 2 in accordance with certain aspects of the present disclosure. As may be seen in FIG. 3, the ice storage assembly 150 includes a lift mechanism 166 and a sweep arm 168 adjacent the lift mechanism 166. The lift mechanism 166 and sweep arm 168 may assist in moving ice from the ice bucket 160 to an ice chute 162 in the manner described below.

Figure 4:
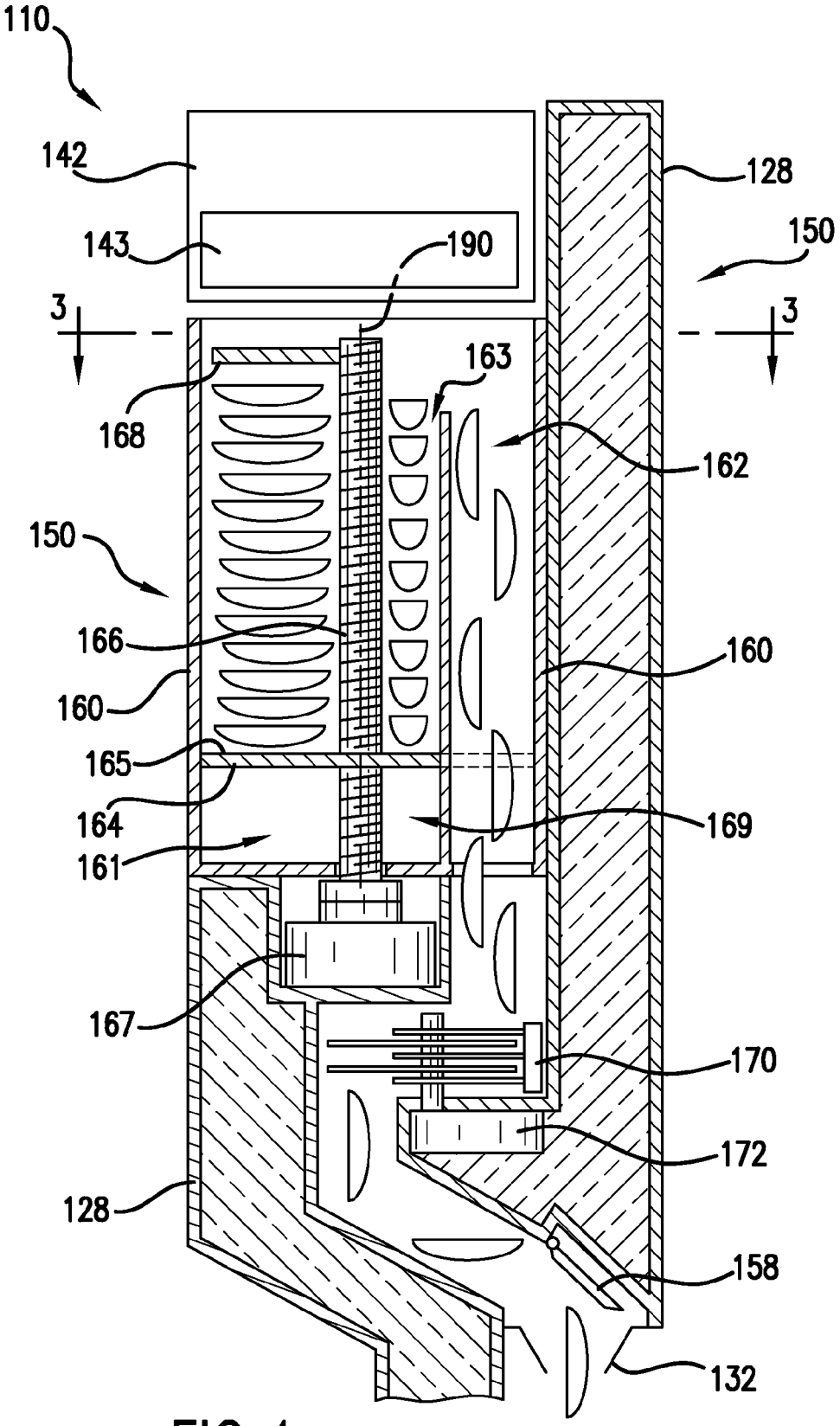
FIG. 4 illustrates a cross-sectional view of the exemplary ice dispenser assembly of FIG. 3 as taken along line 4-4 of FIG. 3.

FIG. 4 illustrates a cross-sectional view of the exemplary ice dispenser assembly 150 of FIG. 3. As may be seen in FIG. 4, an ice maker 143 in the insulated housing 142 is disposed above the ice bucket 160 of the ice dispensing assembly 110 such that ice from the ice maker 143 is received by the ice bucket 160. A platform 164 is disposed within the ice bucket 160 to support the ice deposited by the ice maker 143 into the ice bucket 160. The platform 164 supports ice received by the ice bucket 160 on a top surface 165 of the platform 164. It should also be appreciated that in particular embodiments, such as the embodiment shown in FIG. 4, the platform 164 has a profile that substantially matches a profile defined by the ice bucket 160 (e.g., the profile defined by the ice bucket 160 in FIG. 3). With such substantially matching profiles, ice entering the ice bucket 160 is prevented from entering a cavity 169 defined by the platform 164 and the ice bucket 160. The platform 164 is movable along a vertical axis 190 from a lowered position at a bottom portion 161 of the ice bucket 160 to a raised position at a top portion 163 of the ice bucket 160. Thus, the platform 164 may move ice within the ice bucket 160 along the vertical axis 190 from the lowered position to the raised position.

As shown in FIG. 4, the platform 164 is operatively coupled to a lift mechanism 166 that adjusts the platform 164 from the lowered position to the raised position and vice versa. For this exemplary embodiment, the lift mechanism 166 is a shown as a threaded screw. In such embodiment, the platform 164 threadingly communicates with the lift mechanism 166 such that as the lift mechanism 166 is rotated by a lift motor 167, the platform 164 is raised or lowered as desired based on the direction of rotation provided by lift motor 167. In alternative embodiments, the lift mechanism 166 may be a piston or any other suitable mechanism capable of moving the platform 164 from the lowered position to the raised position and vice versa.

Also shown in FIG. 4 is the sweep arm 168 that assists in transferring ice from the top portion 163 of the ice bucket 160 to the ice chute 162. In the embodiment illustrated in FIG. 4, the sweep arm 168 is a beam projecting perpendicular to the lifting mechanism 166 and adjacent a distal end of the lifting mechanism 166. In such embodiment, the sweep arm rotates 168 as the lifting mechanism 166 rotates in order to lift or lower the platform 164. Thus, as the sweep arm 168 rotates and the platform 164 rises, the sweep arm 168 may engage ice being lifted by the platform 164 and shift or transfer the ice to the ice chute 162 of the ice bucket 160. In alternative embodiments, the sweep arm 168 may rotate independently of the lifting means 166 or in any other suitable manner to transfer ice in the ice bucket 160 to the ice chute 162.

As may be seen in FIG. 4, the ice bucket 160 also includes the ice discharge conduit or ice chute 162. The ice chute 162 is configured to direct the flow of ice from the ice bucket 160 to the dispenser 114 (shown in FIG. 1). Thus, the ice chute 162 may extend from the top portion 163 of the ice bucket 160 to the discharging outlet 132 (shown in FIG. 1). The ice chute 162 of the ice bucket 160 is in communication with the discharging outlet 132. Thus, when in use, ice from the ice bucket 160 enters the ice chute 162 and is channeled through the chute 162 to the discharging outlet 132 upon activation of the paddle 134 (shown in FIG. 1). The ice storage assembly 150 also includes a chute door 158 moveable between an open position and a closed position for passing ice therethrough. The chute door 158 is positioned at a bottom portion of the chute 162, near the discharging outlet 132, and is opened upon activation of the paddle 134. Ice entering the chute 162 upon activation of the paddle 134 is dispensed through the chute door 158 and the discharging outlet 132.

Ice passing through the ice chute 162 may be crushed or allowed to pass though in whole cubes. Thus, an ice crusher 170 is disposed within the ice chute 162 to crush ice or allow whole ice cubes to pass through. To crush ice, a crusher motor 172 rotates the ice crusher 170 in a particular direction, and to pass whole ice, the crusher motor 172 rotates the ice crusher 170 in an opposite direction relative to the particular direction.

In various exemplary embodiments, the refrigerator 100 may include a controller (not shown) that is configured to perform certain functions in response to receiving particular inputs or signals. Accordingly, operation of the refrigerator 100 is regulated by the controller which is operatively coupled to various inputs such as, for example, the control panel 136 and the paddle 134. Thus, in response to user manipulation of the control panel 136 or paddle 134, the controller operates the various components of the refrigerator 100 and executes selected features and functions. The controller may include a memory and microprocessor, CPU or the like, such as a general or special purpose microprocessor operable to execute programming instructions or micro-control code associated with a particular function of the refrigerator 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be configured to activate the lift motor 167 of the lift assembly 164 and thus raise and lower the platform 164, activate the sweep arm 168 and thus assist in transferring ice from the ice bucket 160 to the ice chute 162, activate the crusher motor 172 in order to crush ice passing though the ice crusher 170 or allow the ice to pass in whole cubes, or activate the ice maker 143 in order to dispense ice into the ice bucket 160.

In exemplary embodiments, the controller is configured to active the lift motor 167 in order to raise the platform 164 from the lowered position to the raised position at least in part in response to a user inputting a request for ice such as, for example, depressing the paddle 134 of the dispenser 114. In such embodiments, as the platform 164 is being raised, the controller may also be configured to activate the sweep arm 168 of the ice storage assembly 150 to assist in transferring ice from the ice bucket 160 to the ice chute 162 as the platform 164 is raised and ice is delivered to a top portion 163 of the ice bucket 160 by the platform 164. Ice entering the ice chute 162 from the ice bucket 160 is directed to the discharging outlet 132 where a user may receive the ice.

In exemplary embodiments, the controller is also configured to activate the lift motor 167 in order to lower the platform 164 from the raised position to the lowered position at least in part in response to the user terminating the request for ice such as, for example, releasing the paddle 134 of the dispenser 114 from a depressed configuration. In addition, at a time the controller lowers the platform 164, the controller may also be configured to stop the sweep arm 168 of the ice storage assembly 150 in order to assist in terminating the transfer of ice from the ice bucket 160 to the ice chute 162. When the platform 164 lowers and the sweep arm 168 stops, ice from the ice bucket 160 is no longer urged into the ice chute 162, and thus ice no longer flows to the user.

In additional exemplary embodiments, when the platform 164 is in the lowered configuration at the bottom portion 161 of the ice bucket 160, the controller may activate the ice maker 143 in order to replenish ice transferred to the ice chute 162 from the ice bucket 160. For example, the controller may activate the ice maker 143 at about a time when the platform 164 is being lowered in order to replenish the ice bucket 160 with new ice.

Figure 5:
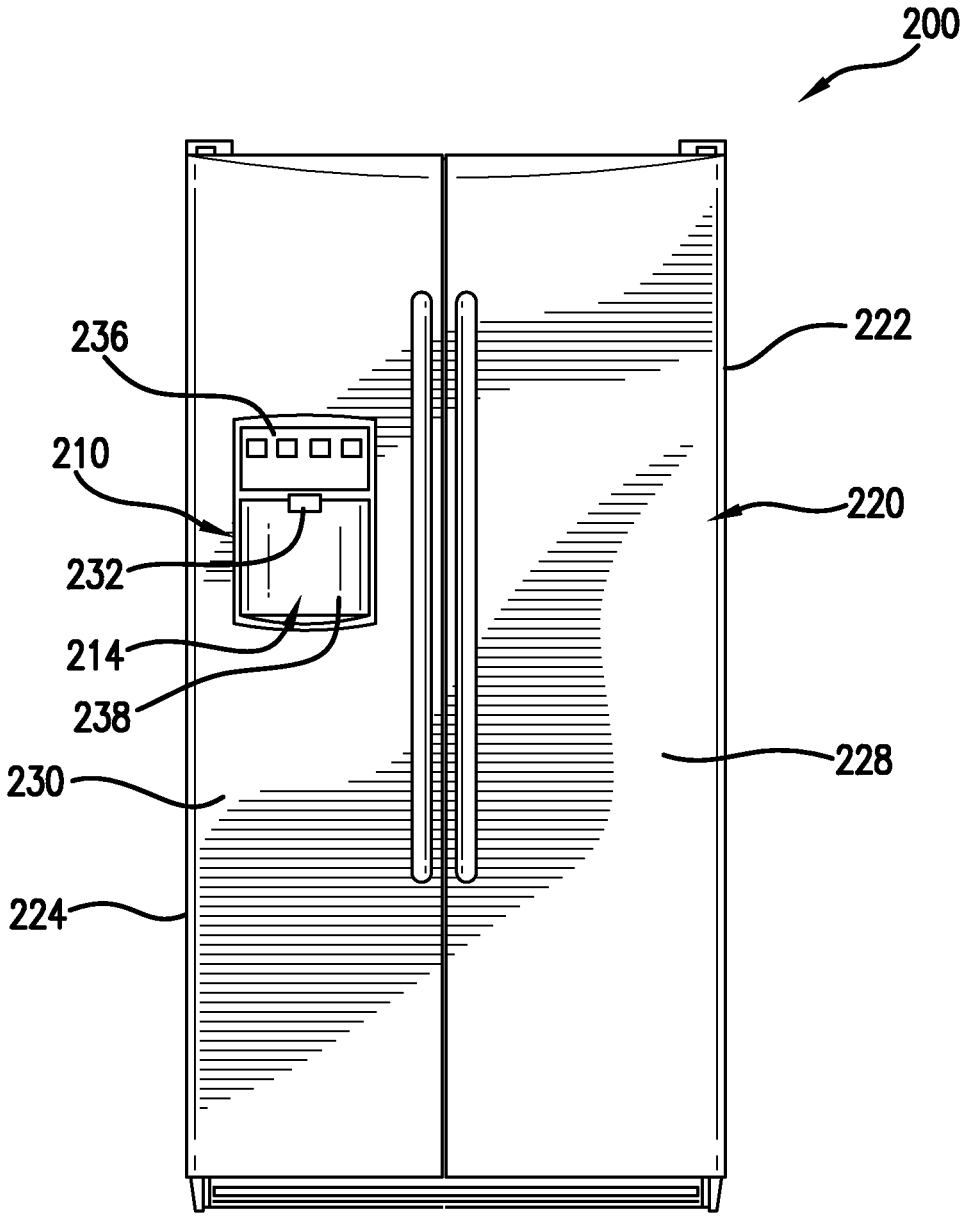
FIG. 5 illustrates a front view of an additional exemplary embodiment of a refrigerator that includes an exemplary ice dispensing assembly in accordance with certain aspects of the present disclosure. The refrigerator of FIG. 5 is generally referred to as a side-by-side style refrigerator.
Figure 6:
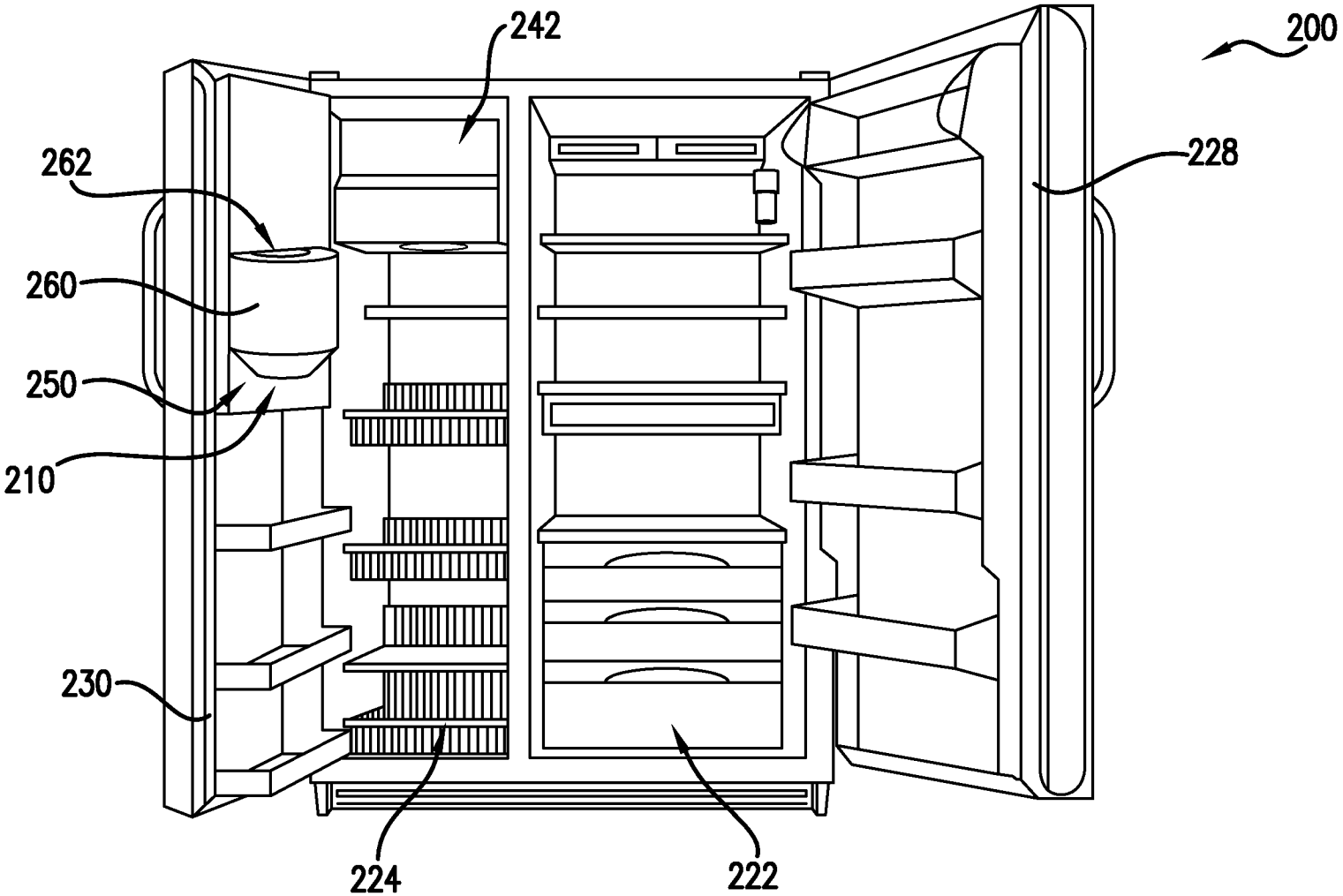

FIGS. 5 and 6, illustrate front views of an additional embodiment of a refrigerator 200. The refrigerator 200 includes a housing 220 defining a fresh food compartment 222 and a freezer compartment 224. The fresh food compartment 222 and the freezer compartment each extend from a top of the housing 220 to a bottom of the housing 224 and are positioned adjacent one another such that from the housing 220 defines the fresh food compartment 222 on one side of the housing 220 and the freezer compartment 224 on an opposite side of the housing 220. As such, the refrigerator 200 is generally referred to as a side-by-side style refrigerator. However, to reiterate, it is recognized that the benefits of the present disclosure apply to other types and styles of refrigerators such as well.

The refrigerator 200 shown in FIGS. 5 and 6 includes components such as, for example, an ice dispensing assembly 210, a dispenser 214, a refrigerator door 228, a freezer door 230, a discharging outlet 232, a control panel 236, a concave portion 238, a housing 242, an ice maker (not shown) disposed within the housing 242, an ice storage assembly 250, an ice bucket 260, and an ice chute 262, that function in a similar manner to the correspondingly named components of the refrigerator 100 of FIGS. 1 and 2. Also, one of skill in the art will understand that in the embodiment shown in FIG. 6, the ice storage assembly 250 may include any of the components, features, and/or, functions of the ice storage assembly 150 of FIGS. 3 and 4. Thus, FIGS. 5 and 6 are intended to illustrate an additional refrigerator embodiment in which the ice storage assembly 150 of FIGS. 3 and 4 can be mounted.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator comprising:

a door configured to permit selective access to a compartment of the refrigerator;

an ice maker; and an ice storage assembly disposed on the door, the ice storage assembly comprising:

an ice bucket configured to receive ice from said ice maker, said ice bucket defining a non-circular cross-section having a concave region;

a platform movable along a vertical axis from a lowered position at a bottom portion of said ice bucket to a raised position at a top portion of said ice bucket, a shape of said platform being complementary to a shape of said ice bucket;

a threaded screw coupled to said platform such that said threaded screw adjusts said platform from the lowered position to the raised position during rotation of said threaded screw;

an ice chute positioned adjacent said ice bucket at said concave region and configured to receive ice from the top portion of said ice bucket; and a sweep arm mounted to said threaded screw such that said sweep arm is vertically fixed relative to said threaded screw, said sweep arm positioned at the top portion of said ice bucket such that said sweep arm rotates with said threaded screw at the top portion of said ice bucket during rotation of said threaded screw.

2. The refrigerator of claim 1, further comprising at least one processing device configured to:

raise said platform from the lowered position to the raised position in response to a user inputting a request for ice; and lower said platform from the raised position to the lowered position in response to the user terminating the request for ice.

3. The refrigerator of claim 1, wherein said sweep arm extends from said threaded screw such that said sweep arm rotates over said ice chute during rotation of said threaded screw.

4. The refrigerator of claim 3, wherein said sweep arm is attached to a distal end of said threaded screw.

5. The refrigerator of claim 3, further comprising at least one processing device configured to:

raise said platform from the lowered position to the raised position at least in part in response to a user inputting a request for ice; and lower said platform from the raised position to the lowered position at least in part in response to the user terminating the request for ice.

6. The refrigerator of claim 1, wherein the ice chute extends between the top portion of said ice bucket and a dispensing outlet of the refrigerator.

7. The refrigerator of claim 6, wherein said ice chute is configured to direct a flow of ice from the top portion of said ice bucket to the dispensing outlet.

8. The refrigerator of claim 1, further comprising an ice crusher disposed within said ice chute.

9. The refrigerator of claim 1, further comprising a motor coupled to said threaded screw such that said motor selectively rotates said threaded screw, the motor positioned below the bottom portion of said ice bucket.

10. The refrigerator of claim 1, wherein said ice maker is disposed within a compartment of the refrigerator such that said ice bucket is positioned below said ice maker when said door is in a closed configuration.

11. The refrigerator of claim 1 wherein said ice maker is disposed on said door above said ice bucket.

12. A method for dispensing ice, the method comprising:

creating ice in an ice maker of a refrigerator;

receiving the ice from said step of creating in an ice bucket on a door of the refrigerator;

rotating a threaded screw within the ice bucket in order to raise a platform of the ice bucket along a vertical axis from a lowered position at a bottom portion of the ice bucket to a raised position at a top portion of the ice bucket, the platform not rotating within the ice bucket during said step of rotating due to the ice bucket defining a non-circular cross-section with a concave region and a shape of the platform being complementary to a shape of the ice bucket; and transferring the ice from the top portion of the ice bucket to an ice chute positioned at the concave region during said step of rotating with a sweep arm fixed to the threaded screw, the sweep arm mounted to the threaded screw such that the sweep arm is vertically fixed relative to the threaded screw.

13. The method of claim 12, wherein said step of raising comprises moving the platform from the lowered position to the raised position at about a time when a user requests ice.

14. The method of claim 13, further comprising lowering the elevator platform from the raised position to the lowered position at about a time when the user stops requesting ice.

15. The method of claim 14, further comprising adding additional ice from the ice maker to the ice bucket after said step of lowering.

16. The method of claim 12, wherein the sweep arm rotates over the ice chute during said step of transferring.

17. The method of claim 16, wherein the ice chute is defined between the door of the refrigerator and the ice bucket.

18. The method of claim 12, further comprising directing the ice through the ice chute to a dispensing outlet of the refrigerator.

* * * * *